US005824114A

United States Patent [19]

Pyo

[11] Patent Number: 5,824,114

[45] Date of Patent: Oct. 20, 1998

[54] CONTROL METHOD FOR DIRECT-COUPLED WASHING MACHINE

[75] Inventor: Sang Yeon Pyo, Yongin, Rep. of Korea

[73] Assignee: Samsung Electronics Co., Ltd., Suwon, Rep. of Korea

[21] Appl. No.: 782,284

[22] Filed: Jan. 13, 1997

[30] Foreign Application Priority Data

Jan. 16, 1996 [KR] Rep. of Korea ..... 1996-714

[51] Int. Cl.[6] ..... D06F 33/02

[52] U.S. Cl. ..... 8/159; 68/12.02; 68/12.12; 68/12.14; 68/12.16

[58] Field of Search ..... 8/159; 68/12.02, 68/12.12, 12.14, 12.16

[56] References Cited

U.S. PATENT DOCUMENTS 5,161,393 11/1992 Payne et al. ..... 68/12.14 X
5,181,398 1/1993 Tanaka et al. ..... 68/12.14 X
5,333,474 8/1994 Imai et al. ..... 68/12.16
5,341,076 8/1994 Bahn .
5,373,206 12/1994 Lim .

*Primary Examiner*—Philip R. Coe
*Attorney, Agent, or Firm*—Larson & Taylor

[57] ABSTRACT

Disclosed is a direct-coupled washing machine and a control method thereof. The direct-coupled washing machine connects the rotation shaft of a switched reluctance washing motor to the rotation shafts of both a pulsator and a dehydration water tub. The direct-coupled washing machine has a pulsator which is mounted in the dehydration water tub which forwardly or reversely rotates in a washing procedure to thereby agitate the laundry. The washing machine includes: a washing motor which has a copper-core rotation shaft connected with the dehydration water tub and the pulsator, and generates rotational force; a reduction portion which reduces the speed of the rotational force generated by the washing motor by using a constant ratio; and a connection switching portion which is connected to the rotation shaft of the pulsator in a washing procedure by connecting the reduction portion to the rotation shaft of the washing motor, and is directly connected to the rotation shaft of the dehydration water tub in a dehydration step by not connecting the rotation shaft of the washing motor to the reduction portion.

1 Claim, 7 Drawing Sheets

FIG.2
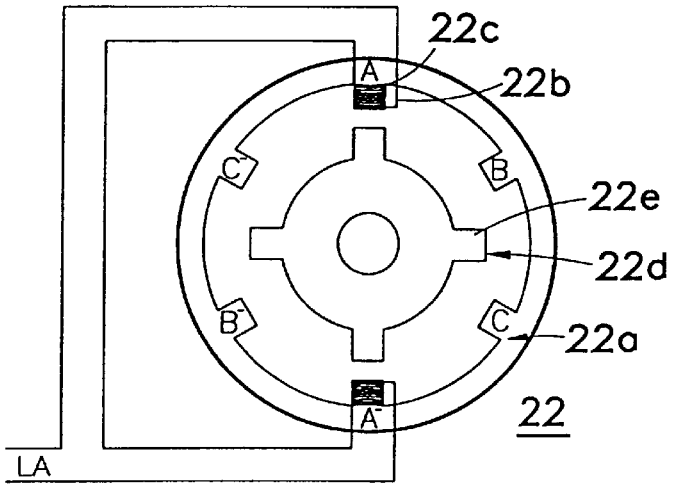
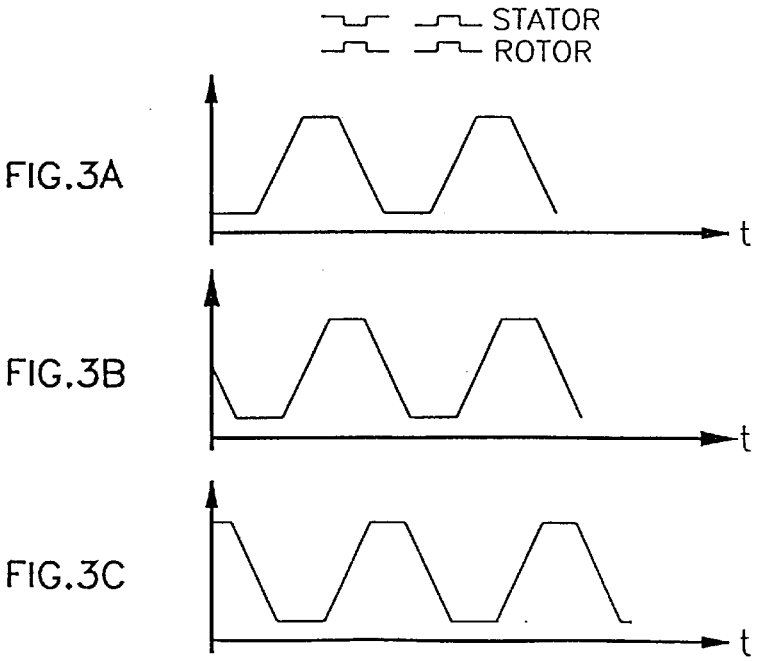

CONTROL METHOD FOR DIRECT-COUPLED WASHING MACHINE

BACKGROUND OF THE INVENTION (1) Field of the Invention

The present invention relates to a direct-coupled washing machine and a control method thereof. More particularly, it relates to a direct-coupled washing machine having a switched reluctance motor (hereinafter referred to as an SR motor) and a dehydration control method thereof, the direct-coupled washing machine connecting the rotation shaft of the washing motor to the rotation shaft of both a pulsator and a dehydration water tub.

(2) Description of the Prior Art

The conventional arts using a reluctance motor are as follows.

Firstly, the U.S. Pat. No. 5,341,076 filed on Feb. 12, 1992, entitled "HIGH-SPEED RELUCTANCE MOTOR", relates to a small-sized reluctance motor which rotates at a high speed and torque, and suppresses vibrations.

The U.S. Pat. No. 5,373,206 filed on Feb. 17, 1993, includes: a single sensor for detecting a rotor's position, a detector for what is that outputting a position detection signal from the single sensor and a driving signal, and a pulse generation circuit which receives the position detection signal and then generates a driving control pulse to each phase excitation circuit. The U.S. Pat. No. 5,373,206 provides for a position detection error signal based on only one position detection sensor, thereby reducing production costs.

In addition, Japanese Patent Laid-open Publication Hei. 6-245580, filed on Feb. 10, 1993, provides for a constant speed motor without noises of a position detection signal.

A conventional washing machine will now be described with reference to the attached drawings.

FIG. 9 schematically shows a cross-sectional view of a washing machine in accordance with the prior art; and FIG. 10 schematically shows a cross-sectional view of a shaft assembly in accordance with the prior art.

As shown in FIG. 9, a washing machine according to the conventional art includes: a cylindrically-shaped water tub 2 mounted in the inside of the outer case 1; a dehydration water tub 3 which is rotatably mounted in the water tub 2, has a plurality of holes 3*a* allowing water to be in continual communication with the water tub 2, and holds the laundry therein; a pulsator 4 which is rotatably mounted on the bottom of the dehydration water tub 3 to agitate the laundry; a washing motor 5 which is mounted toward the outer side of the lower part of the water tub 2, generates rotation power for forwardly or reversely rotating the dehydration water tub 3; a shaft assembly 7 mounted in the bottom center of the dehydration water tub 3; and a belt 9 which connects a pulley 6 coupled with the rotation shaft of the washing motor 5 to a pulley 8 coupled with the rotation shaft of the shaft assembly.

A reference number 10 shown in FIG. 9 is a clutch lever. A reference number 11 is a drain duct. And a reference number 11*a* is a drain valve.

As shown in FIG. 10, the shaft assembly 7 in detail includes a pulley 8, a first shaft 12, a planetary gear 13, a second shaft 14, a clutch lever 10, a clutch spring 15, a case drum assembly 16, and a connection member 17.

Operations of the conventional washing machine according to the aforementioned structure will now be described.

Referring to FIGS. 9 and 10, operations in a rinsing step are as follows.

A pulley 8 receives rotational force from the washing motor 5 and reduces the revolution per minute (hereinafter referred to as rpm) by about half. This reduced speed is then transmitted through the first shaft 12 to a planetary gear 13, which additionally reduces the speed. Contrary, the second shaft 14 transmits the torque which is reduced by the planetary gear 13 to the pulsator 4, which thereby agitates the laundry.

Next, referring to FIGS. 9 and 10, operations of a dehydration step are as follows.

When the clutch lever 10 is manipulated by a solenoid valve, the clutch spring 15 is wound. At this time, the entire case drum assembly 16 rotates the pulley 8. Accordingly, the torque of the washing motor 4 is directly transmitted to the dehydration water tub 3 by the connection member 17 without being reduced by the planetary gear 13, thereby rotating the dehydration water tub 3 at a high speed.

Since the conventional art requires a clutch apparatus and a brake apparatus to switch between the washing and dehydration functions, the structure and assembly process of this type of washing machine are complicated. In addition, the rotation shaft of the washing motor is not directly coupled with a rotation shaft of the dehydration water tub, resulting in an eccentric status. Accordingly, noise is generated during the dehydration step.

SUMMARY OF THE INVENTION

Accordingly, the present invention relates to a direct-coupled washing machine and a control method thereof that substantially obviate one or more of the aforementioned problems due to limitations and disadvantages of the related art.

The object of the present invention is to provide a direct-coupled washing machine and a control method thereof which simplify the washing machine's structure and assembly process by connecting the rotation shaft of the washing motor to the rotation shaft of both the pulsator and the dehydration water tub, and separately controlling the dehydration function before or after the starting the washing motor, thereby preventing resultant noise.

In order to achieve this object and others, a direct-coupled washing machine includes:

- a washing motor with a copper-core rotation shaft connected to the dehydration water tub that generates rotational force;
- a reduction portion which reduces the rotational speed generated by the washing motor by using a constant ratio; and
- a connection switching portion which is connected to the rotation shaft of the pulsator in a washing procedure by connecting the reduction portion to the rotation shaft of the washing motor, and is directly connected to the rotation shaft of the dehydration water tub in a dehydration step by not connecting the rotation shaft of the washing motor to the reduction portion.

The method for controlling the direct-coupled washing machine which has a washing motor with a phase detecting portion for detecting the rotor's position in relation to each stator winding of the washing motor, the method including the steps of:

- judging whether a dehydration step is being performed;
- sensing the speed of the washing motor when the dehydration step is being performed;
- relatively increasing the conduction time of each stator winding when the washing motor is rotating below a constant starting speed; and relatively reducing the conduction time of each stator winding when the washing motor is rotating faster than the constant starting speed.

BRIEF DESCRIPTION OF THE DRAWINGS

The preferred embodiment of the present invention will now be described more specifically with reference to the attached drawings, wherein:

FIG. 2 schematically shows a cross-sectional view of an SR motor in accordance with the present invention;

FIGS. 3A to 3C depact waveforms showing the phase relation of inductances between the stator and the rotor shown in FIG. 2;

FIG. 10 schematically shows a cross-sectional view of a shaft assembly in accordance with the prior art.

DETAILED DESCRIPTION OF THE PREFERRED EMBODIMENT

The preferred embodiment of the present invention will become apparent from a study of the following detailed description, when viewed in conjunction with the accompanying drawings.

Figure 1:
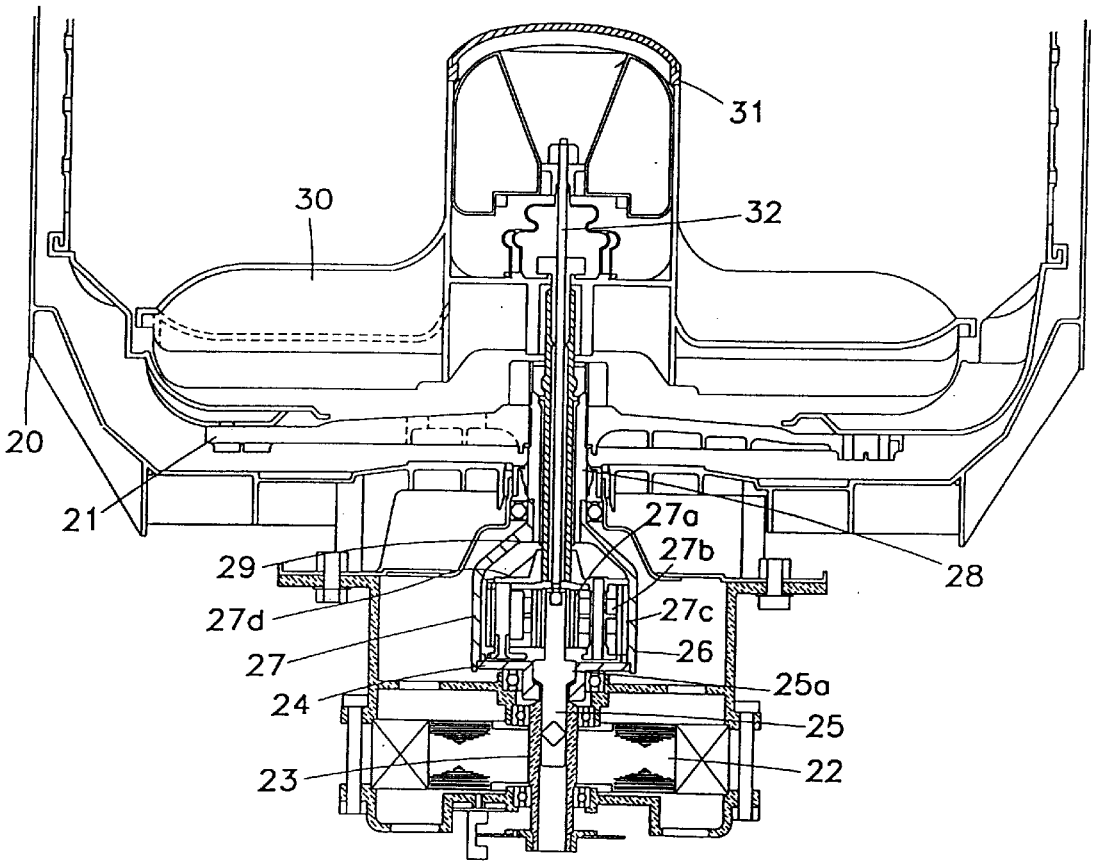
FIG. 1 schematically shows a cross-sectional view of a direct-coupled washing machine's shaft assembly in accordance with the art of the present invention.

As shown in FIG. 1, the inventive direct-coupled washing machine includes:

- a dehydration water tub 21 which is mounted in a water tub 20;
- a pulsator 30 which is rotatably mounted on the bottom of the dehydration water tub 21;
- a washing motor 22 which is fixed to the center of the underside of the water tub 20, has a copper-core rotation shaft connected with the dehydration water tub 21 and the pulsator 30, and generates rotational force;
- a drum 26, mounted in the inside top of the washing motor 22, that reduces rotational force generated by the washing motor 22 with a constant ratio; and
- a connection switching rod 32 which, during a washing procedure, is connected to the rotation shaft of the pulsator 30 by connecting the drum 26 to the rotation shaft of the washing motor 22, and is directly connected to the rotation shaft of the dehydration water tub 21 in a dehydration step by not connecting the rotation shaft of the washing motor 22 to the drum 26.

Figure 6:
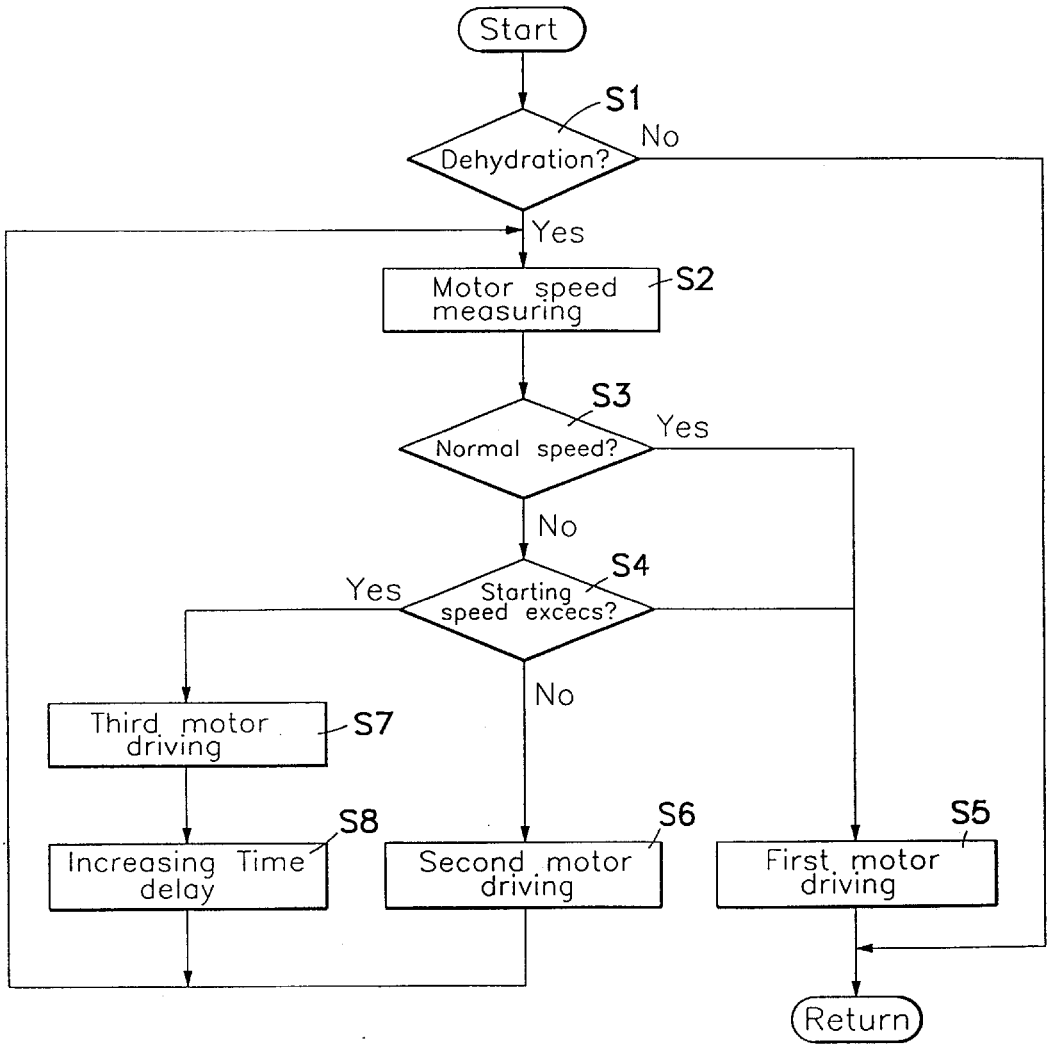
FIG. 6 is a flow chart of the control method for the dehydration step executed by a direct-coupled washing machine in accordance with a preferred embodiment of the present invention.

Referring to FIG. 6, the dehydration control method of the inventive direct-coupled washing machine includes:

- a step S1 for judging whether a dehydration step is being performed;
- a step S2 for measuring a motor speed of the washing motor while the dehydration step is being performed;
- a normal speed judging step S3 which judges whether the motor is spinning at a predetermined normal speed;
- a starting speed judging step S4 which, if the motor is not spinning at the normal speed of step S3, judges whether the speed is beyond a constant starting speed;
- a second motor driving step S6 which, if the motor's speed is not at the starting speed of step S4, drives the motor by directly driving a switching element by an output signal of a phase sensor, and then returns to the normal speed judging step S3 in order to judge whether the driven motor's speed is at the normal speed;
- a third motor driving step S7 which receives the output signal of the phase sensor when the motor's speed is beyond a constant starting rpm in the starting rpm judging step S4, and drives the motor by driving a switching element after a constant time delay;
- a step S8 which relatively reduces the conduction time of each stator winding according to the motor's speed in the third motor driving step S7, and returns to the normal speed judging step S3 in order to judge whether the motor's speed is the normal rpm; and
- a first motor driving step S5 which drives the motor during a predetermined dehydration step when the motor's speed is the normal rpm in the normal speed judging step S3, and then finishes a dehydration step.

The direct-coupled washing machine and the dehydration control method in accordance with a preferred embodiment of the present invention will now be described more specifically.

As shown in FIG. 1, the dehydration water tub 21 is mounted in the inside of the water tub 20. the pulsator 30 is retatably mounted on the bottom of the dehydration water tub 21. The washing motor 22 is fixed to the center of the underside of the water tub 20, has a rotation shaft of the dehydration water tub 21 and the pulsator 30, and generates rotational force. A drum 26, mounted in the inside top of the washing motor 22, that reduces the rotational force generated by the washing motor 22 with a constant ratio.

A connection switching rod 32, elevated or lowered by the amount of washing water in the tube, is connected to the rotation shaft of the pulsator 30 in a washing procedure by connecting the drum 26 to the rotation shaft of the washing motor 22, and is directly connected to the rotation shaft of the dehydration water tub 21 in a dehydration step by not connecting the rotation shaft of the washing motor 22 to the drum 26.

The gear unit 27 is similar to a gear unit of the prior shaft assembly. A sun gear 27*a* is disposed in the center of the gear unit 27. Planetary gears 27*b* are gear-coupled with the sun gear 27*a*, centering around the sun gear 27*a*. A ring gear 27*c* is gear-coupled with the planetary gears 27*b*. Center shafts of the planetary gears 27*b* are coupled to each other by a carrier 27*d*.

In addition, the rotation shaft of the sun gear 27*a* is hollow. A coupling shaft 25 to be serrulate-coupled is inserted between this hollow and a hollow formed in the rotation shaft 23 of the washing motor 22, and is therefore elevated between the hollows. A coupling boss 25*a* which is connected to a coupling groove or released from the connection groove according to its elevation operation, is formed in the coupling shaft 25. The center of the carrier 27*d* is vertically extended, and is fixedly connected to a hollow rotation shaft 29 fixedly connected to the pulsator 30.

A buoyancy case 31 mounted in the pulsator 30 can be elevated. The coupling shaft 25 is connected to the buoyancy case 31 by the connection switching rod 32. Here, the connection switching rod 32 is loosely inserted in the hollow of the rotation shaft 29.

On the other hand, the drum 26 is fixedly connected to the dehydration water tub 21 by a connection member 28. A gear case 24 with the coupling groove in its center part thereof is fixedly coupled to the center of the lower part of the drum 26. Accordingly, according to the elevation operation of the coupling shaft 25, the coupling boss 25*a* is connected to the coupling groove, or is released from the coupling groove.

Whenthe the direct-coupled washing machine executes a washing procedure, as water is supplied to the water tub 20, the buoyancy case 31 is elevated. Accordingly, the connection switching rod 32 and the coupling shaft 25 are sequentially elevated so that the connection between the coupling boss 25*a* and the coupling groove is released. When the washing motor 22 rotates while this arrangement is in place, the rotational force is reduced by the planetary gear 27*b* and is transmitted to the rotation shaft 29. As a result, the pulsator 30 is forwardly or reversely rotated with a large torque and a low-speed.

During a dehydration step, as the washing water is drained, the buoyancy case 31 is lowered. Accordingly, the connection switching rod 32 and the coupling shaft 25 are sequentially lowered so that the coupling boss 25*a* is connected to the coupling groove. Therefore, the drum 26, the planetary gear 27*b*, the sun gear 27*a* and the ring gear 27*d* are rotated at the same high speed, thereby performing the dehydration.

In addition, the washing motor used for the direct-coupled washing machine according to the present invention is preferably embodied as an SR motor.

FIG. 2 schematically shows a cross-sectional view of an SR motor in accordance with a preferred embodiment of the present invention; and FIGS. 3A to 3C depict waveforms showing the phase relation of inductances between the stator and the rotor shown in FIG. 2.

As shown in FIG. 2, in the SR motor structure, a plurality of stator bosses are symmetrically formed in the inside of a stator 22*a*. A stator winding 22*c* is directly connected to each stator boss 22*b*. A rotation shaft 23 is arranged in the center of the rotor 22*d*. A plurality of rotor bosses 22*e* are formed on the circumference of the rotation shaft.

In the SR motor as described above, when the stator boss 22*b* is accurately facing the rotor boss 22*d*, the inductance between them is maximized. On the contrary, when the stator boss 22*b* is completely crossed each other, the inductance between them becomes minimized.

Therefore, since power is supplied to the phase C winding when the stator boss 22*b* related to the phase A is facing the rotor 22*e*, the phase C boss is magnetized. Thus, the rotor boss 22*e* accesses to the phase C boss. Likewise, when the phase B boss is magnetized, the rotor 22*d* rotates clockwise with rotational force. At this time, in order to rotate the rotor 22*d* counterclockwise, the stator boss should be excited according to a procedure such as phase A=>phase B=>phase C.

Figure 4:
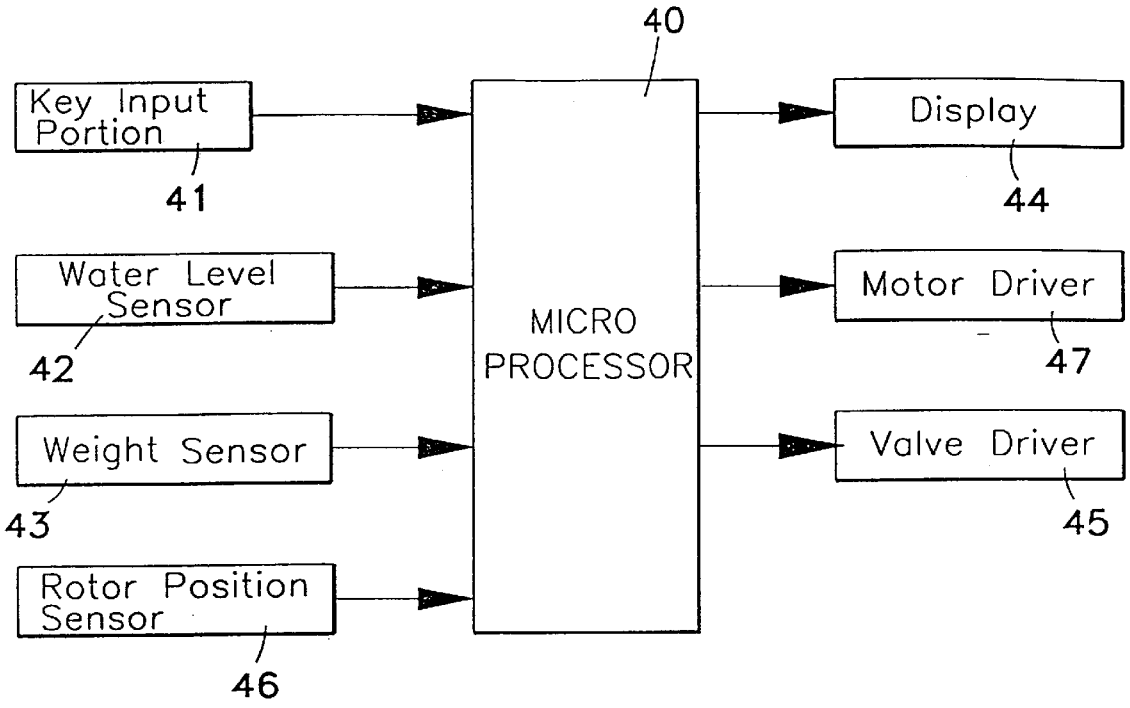
FIG. 4 is a schematic diagram illustrating the operation controller of a direct-coupled washing machine in accordance with a preferred embodiment of the present invention.
Figure 5:
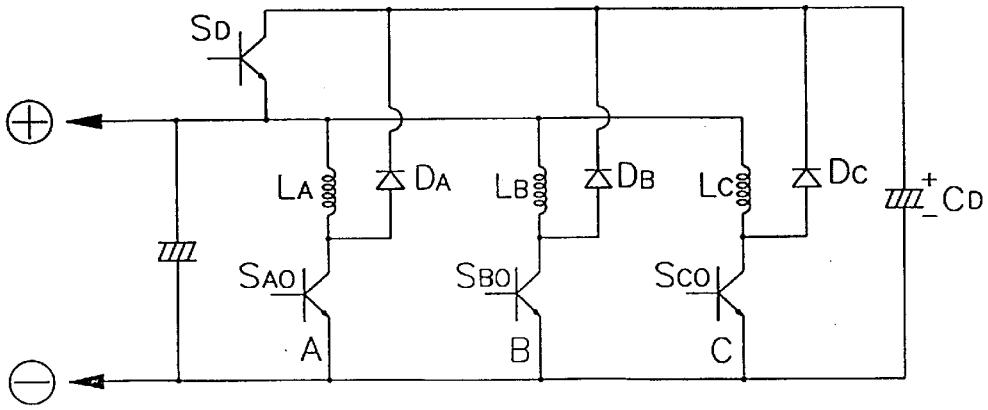
FIG. 5 is a detailed circuit diagram of a washing motor driving means shown in FIG. 4.

FIG. 4 is a block diagram illustrating an operation controller of a direct-coupled washing machine in accordance with a preferred embodiment of the present invention; and FIG. 5 is a detailed circuit diagram of the washing motor driving means shown in FIG. 4.

As shown in FIG. 4, the operation controller of the direct-coupled washing machine according to the present invention includes:

- a microprocessor 40 which controls the entire operation of the washing machine including the operation of the washing motor 22;
- a key input portion 41 for receiving a desired operation condition;
- a water level sensor 42 for sensing the water level in the washing machine;
- a weight sensor 43 for sensing the quantity of the laundry;
- a rotor position sensor 46 which senses the position of a rotor boss 22*d* in relation to each stator boss 22*b* in the washing motor 22;
- a display 44 for displaying the current operation status;
- a washing motor driver 47 for driving the washing motor 22; and
- a valve driver 45 for driving a water supply valve and a drain valve.

The rotor position sensor 46 is preferably embodied as a photo-coupler arranged in each stator winding 22*c*.

As shown in FIG. 5, in the motor driver 47, for example, three stator windings $L_A$, $L_B$ and $L_C$ are connected in parallel to both terminals of a DC power source of a constant magnitude. Switching transistors $S_{AO}$, $S_{BO}$ and $S_{CO}$ are connected in series to the stator windings $L_A$, $L_B$ and $L_C$. At this time, the stator windings $L_A$, $L_B$ and $L_C$ are connected in parallel to diodes $D_A$, $D_B$ and $D_C$ for forming a back electromotive current path, the diodes being juxtaposed with the switching transistors $S_{AO}$, $S_{BO}$ and $S_{CO}$. A condenser $C_D$ for collecting the back electromotive current is connected to the diodes $D_A$, $D_B$ and $D_C$ and the negative terminal (−) of the DC power.

Herein, a reference number $S_D$ is a switching transistor for adding a charged back electromotive force to the condenser $C_D$ during an excitation phase of stator windings $L_A$, $L_B$ and $L_C$. The switching transistor $S_D$ is turned on when all switching transistors $S_{AO}$ $S_{BO}$ and $S_{CO}$ are turned on, so that the excitation current is supplemented.

FIG. 6 is a flow chart of the dehydration control method for a direct-coupled washing machine in accordance with a preferred embodiment of the present invention.

Firstly, a user turns on the main power of the washing machine and determines a desired washing condition through the key input portion 41. The microprocessor 40 receives the desired washing condition, and performs a washing procedure (i.e., washing→rinsing of predetermined numbers→dehydration).

Next, the washing machine performs a water supply step by sending a control signal to the valve driver 45. At this time, whether the water level sensed by the water level sensor 42 has reached a predetermined point, or the water level is automatically determined on the basis of the laundry quantity sensed by the weight sensor 43, is determined.

If the water level reaches to the predetermined point, the water supply step is discontinued and the washing motor 22 is forwardly or reversely rotated according to a given conduction pattern. At this time, the operation is the same as the aforementioned description. In this way, when the washing step and the rinsing step are terminated, a dehydration step is performed as shown in FIG. 6.

Referring to FIG. 6, the dehydration control method of the direct-coupled washing machine in accordance with a preferred embodiment of the present invention is as follows.

First, whether a dehydration step is performed is determined. If the dehydration step is being performed, the speed of the washing motor is measured S2 by utilizing the output signal of the rotor position sensor 46.

Then, whether the motor's speed is at a predetermined normal speed is discerned S3.

If the motor's speed is not at the normal speed, a starting speed judging step S4 determines if it is beyond a constant starting rpm.

If it is not, the second motor driving step S6 drives the motor by directly driving a switching element by the output signal of a phase sensor. Then the routine returns to step S2 to again measure the speed of the motor.

If the motor's speed is beyond the constant starting rpm in step S4, the third motor driving step S7 receives the output signal of the phase sensor and drives the motor by driving the switching element after a settingt time delay.

The step S8 relatively reduces the conduction time of each stator winding according to the motor rpm in the third motor driving step S7, and returns to S2 where the motor's speed is again measured.

If, in step S3, the motor's speed is at the normal rpm, the first motor driving step S5 is executed, wherein a corresponding phase winding is excited without the time delay at the same time a sensed signal about the corresponding phase winding is received. The reason why the step S5 is controlled in this manner is that a large starting torque is required in an initial starting. If there is a time delay, the rotation may stop. Accordingly, step S5 can prevent this problem.

If, in step S4, the motor's speed is at the starting rpm, steps S7 and S8 are executed. The stator windings $L_A$, $L_B$ and $L_C$ are sequentially excited as the delay time x is increased in proportion to the speed of the motor until the motor's speed has reached the normal rpm. In repeating these steps, if the speed of the washing motor 22 reaches the normal rpm in step S3, step S5 begins. Thus, the stator windings $L_A$, $L_B$ and $L_C$ are excited as the delay time x is fixed.

In addition, when the motor's speed is the normal rpm in the normal speed judging step S3, a first motor driving step S5 drives the motor as much as a predetermined dehydration time, and then finishes the dehydration step.

That is, after the washing motor starts operating, the motion of the rotor 22*d* is partially due to inertial force. Thus, the rotor smoothly rotates requiring only small power. The delay time x prevents overheating of the washing motor 22 and reduces power consumption.

Furthermore, a spacing between the rotation shaft 23 of the washing motor 22 and the coupling shaft 25 is required to achieve smooth movement.

The present invention separately controls a washing machine's function before or after the starting of the washing motor.

That is, the control method according to the present invention drives the motor by relatively increasing the conduction time of each stator winding when the washing motor's speed is below a constant starting rpm, or by relatively reducing the conduction time of each stator winding when the washing motor's rpm is beyond the constant starting rpm. The result is the reduction of noise generated by the the coupling shaft 25 within the rotation shaft 23 during the execution of the dehydration step.

Figure 7:
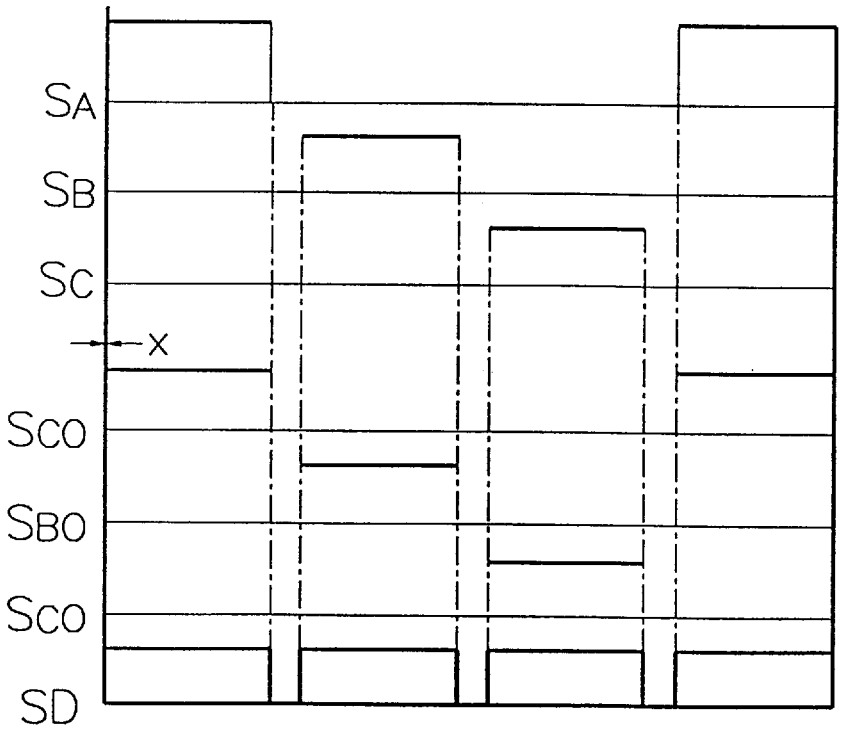
FIG. 7 shows waveforms illustrating conduction patterns of each phase winding when initially driving a direct-coupled washing machine in accordance with a preferred embodiment of the present invention.

FIG. 7 shows waveforms illustrating conduction patterns of each phase winding when initially driving a direct-coupled washing machine. FIG. 7 shows that switching transistors are driven without the time delay x about the outputs of the position sensors.

Figure 8:
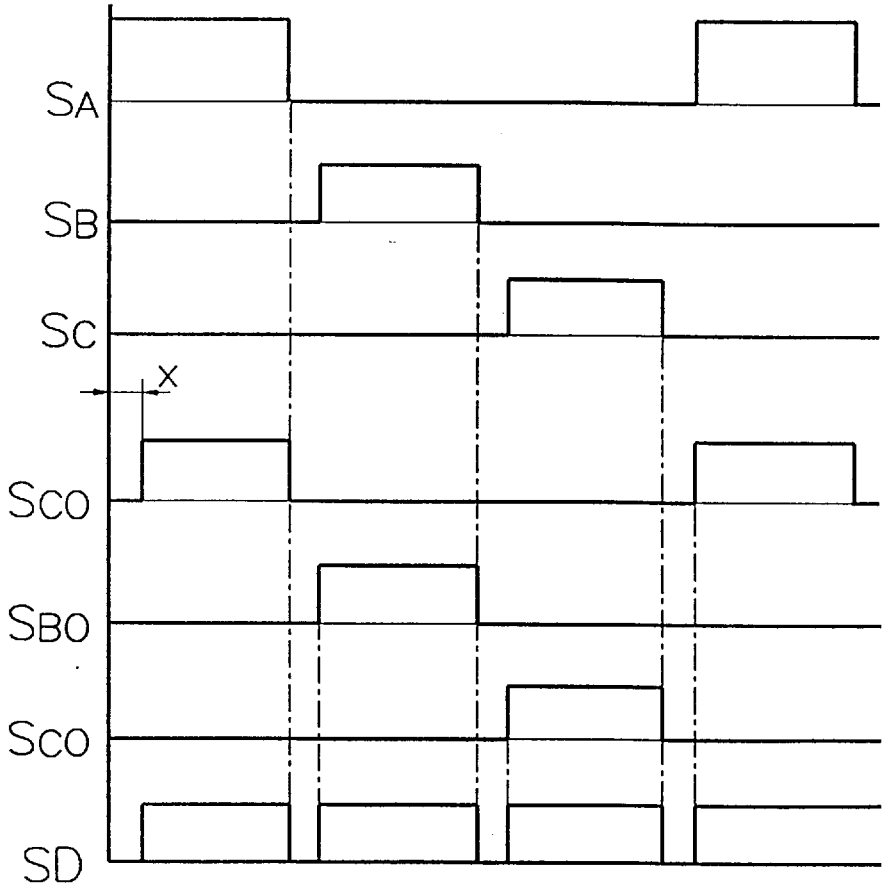
FIG. 8 shows waveforms illustrating conduction patterns of each phase winding after driving a direct-coupled washing machine in accordance with a preferred embodiment of the present invention.
Figure 9:
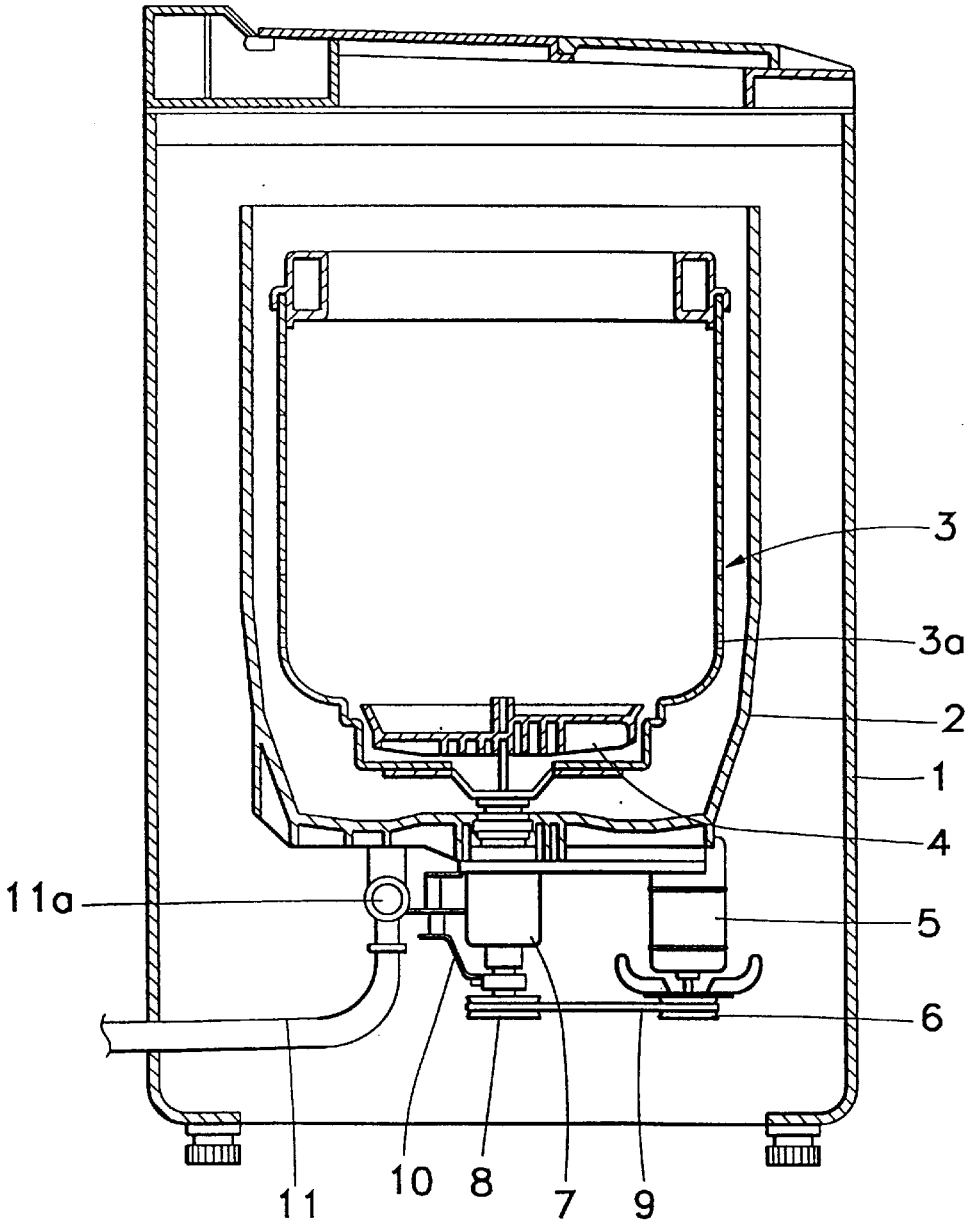
FIG.9 (PRIOR ART)
FIG. 9 schematically shows a cross-sectional view of a washing machine in accordance with the prior art.

FIG. 8 shows waveforms illustrating conduction patterns of each phase winding after driving a direct-coupled washing machine. FIG. 8 shows that the switching transistors are driven after a constant time delay x about the outputs of the position sensors.

Since the conventional art requires clutch and brake apparati to switch between a washing cycle and a dehydration cycle, the structure and assembly process of a traditional washing machine are complicated. In addition, the rotation shaft of the washing motor is not directly coupled with the rotation shaft of the dehydration water tub, thereby causing an eccentric status. Accordingly, excess noise is generated in the dehydration step.

As described above, the present invention simplifies the structure and assembly process by connecting the rotation shaft of the washing motor to the rotation shaft of both the pulsator and the dehydration water tub, and remarkably reduces excess noise generated during the dehydration step by removing the eccentric status.

It will be apparent to those skilled in the art that various modifications and variations can be made in a lamp driving control apparatus for a washing machine and a control method thereof of the present invention without departing from the spirit or scope of the invention. Thus, it is intended that the present invention cover the modifications and variations of this invention provided they come within the scope of the appended claims and their equivalents.

What is claimed is:

1. A method for controlling a direct-coupled washing machine having a washing motor embodied as a switched reluctance motor, said washing motor having a copper-core rotation shaft connected with said dehydration water tub, said method comprises the steps of:

judging whether a dehydration step is being performed;

sensing a speed of said washing motor when said dehydration step is being performed;

relatively increasing the conduction time of each stator winding when said washing motor's rpm is below a constant starting rpm; and relatively reducing said conduction time of each stator winding when said washing motor's rpm is beyond said constant starting rpm.

* * * * *